US008189833B2

(12) United States Patent
Klinkby et al.

(10) Patent No.: US 8,189,833 B2
(45) Date of Patent: May 29, 2012

(54) HEARING AID AND A METHOD OF PROCESSING INPUT SIGNALS IN A HEARING AID

(75) Inventors: Kristian Tjalfe Klinkby, Varlose (DK); Jorgen Cederberg, Farum (DK); Helge Pontoppidan Foeh, Bagsvard (DK); Peter Magnus Norgaard, Frederiksberg (DK); Thilo Volker Thiede, Ballerup (DK)

(73) Assignee: Widex A/S, Lynge (DK)

( * ) Notice: Subject to any disclaimer, the term of this patent is extended or adjusted under 35 U.S.C. 154(b) by 1023 days.

(21) Appl. No.: 12/100,539

(22) Filed: Apr. 10, 2008

(65) Prior Publication Data

US 2008/0253596 A1 Oct. 16, 2008

Related U.S. Application Data

(63) Continuation-in-part of application No. PCT/DK2005/000654, filed on Oct. 11, 2005.

(51) Int. Cl.
*H04R 25/00* (2006.01)

(52) U.S. Cl. ..... 381/313; 381/312

(58) Field of Classification Search ..... 381/313, 381/92, 356, 312, 318
See application file for complete search history.

(56) References Cited

U.S. PATENT DOCUMENTS

| | | | | |
|---|---|---|---|---|
| 6,072,884 | A | 6/2000 | Kates et al. | |
| 7,010,134 | B2 * | 3/2006 | Jensen | 381/313 |
| 7,155,019 | B2 * | 12/2006 | Hou | 381/92 |
| 7,463,745 | B2 * | 12/2008 | Miller, III | 381/318 |
| 7,519,193 | B2 * | 4/2009 | Fretz | 381/312 |
| 7,688,985 | B2 * | 3/2010 | Roeck | 381/92 |
| 2003/0053646 | A1 * | 3/2003 | Nielsen et al. | 381/312 |
| 2007/0206824 | A1 * | 9/2007 | Hellgren et al. | 381/313 |

FOREIGN PATENT DOCUMENTS

| | | | |
|---|---|---|---|
| EP | 1191814 | A1 | 3/2002 |
| EP | 1469702 | A2 | 10/2004 |
| JP | 618397 | A | 7/1994 |
| JP | 2002218583 | A | 8/2002 |
| WO | WO 99/26453 | A1 | 5/1999 |
| WO | WO 01/01731 | A1 | 1/2001 |
| WO | WO 01/10169 | A1 | 2/2001 |
| WO | WO 02/085066 | A1 | 10/2002 |
| WO | WO 2005/091675 | A1 | 9/2005 |

OTHER PUBLICATIONS

Herbordt et al, "Computationally Efficient Frequency-Domain Combination of Acoustic Echo Cancellation and Robust Adaptive Beamforming", EUROSPEECH—vol. 2 , Sep. 2001, p. 1001, XP007004503.

Japanese Office Action for 2008-523597 dated Jan. 11, 2011 with English translation.

* cited by examiner

*Primary Examiner* — Davetta W Goins
*Assistant Examiner* — Phan Le
(74) *Attorney, Agent, or Firm* — Sughrue Mion, PLLC

(57) ABSTRACT

A hearing aid comprises two microphones, directional processing means for combining the respective audio signals to form a spatial signal, a beamformer for controlling the directional processing means to provide adaptation of the spatial signal, and means for boosting low frequencies of the spatial signal. A feedback estimator generates a feedback compensation signal, which is combined with the boosted spatial signal. By applying feedback compensation only after directional processing and low frequency boosting, the device avoids interference by the feedback estimator with the function of the beamformer. The invention also provides a method of processing signals in a hearing aid.

13 Claims, 7 Drawing Sheets

HEARING AID AND A METHOD OF PROCESSING INPUT SIGNALS IN A HEARING AID

RELATED APPLICATIONS

The present application is a continuation-in-part of application No. PCT/DK2005/000654; filed on 11 Oct. 2005, in Denmark and published as WO2007042025, the contents of which are incorporated hereinto by reference.

BACKGROUND OF THE INVENTION

1. Field of the Invention

The present invention relates to hearing aids. The invention further relates to methods of signal processing within a hearing aid. The invention more particularly relates to hearing aids with multiple input transducers and to methods of signal processing in hearing aids with multiple input transducers. The invention, still more particularly, relates to hearing aids with multiple input transducers adapted to provide an adjustable directivity pattern.

The invention, yet more specifically, relates to an input processor for processing of input transducer signals in a hearing aid, wherein input signals are processed in a directional controller and wherein feedback-compensating signals are combined with signals derived from the input signals.

2. The Prior Art

WO-A-01/01731 shows the use of an adjustable directional microphone system for a hearing aid. The system processes inputs from two microphones according to acoustical time delays to achieve a directional sensitivity pattern. The processor may also compensate the suppression of low frequency signals inherent to directional processing, an action sometimes referred to as equalizing or low frequency boosting. Directional processing is typically used to suppress environmental noise in situations where the hearing aid user wants to suppress sounds impinging from directions other than that towards a conversational partner. Equalizing generally boosts the low frequency signals, whether they are regarded as signals of interest or noise, and therefore may cause problems on its own.

WO-A-02/085066 shows a directional system, which is adaptively controlled. The directional controller may be implemented in a multi-channel version, i.e. with delay processors in respective frequency bands.

EP-A-1191814 shows a system for alleviating a disturbance known as acoustical feedback. Acoustical feedback refers to the incidence at the microphone of an acoustic signal generated by the output transducer. The feedback signal is likely to be picked up by the microphone and amplified by the hearing aid processor to give rise to an output that will again loop back to the microphone. If the gain exceeds the attenuation factors in the loop, an unstable situation will arise. Feedback may give rise to distortion of the signal, even at gain settings below the instability limit. EP-A-1191814 describes an adaptive feedback compensation (FBC) system, wherein a feedback-compensating signal is subtracted from the output of the microphone system in order to produce a combination signal, which is then fed to the main signal processor.

The feedback compensation signal is generated in a feedback signal predictor that monitors the output signal from the main signal processor, i.e. the signal fed to the output transducer of the hearing aid, and the input signal to the main signal processor. By correlating these signals, the feedback predictor can work out an estimate of the feedback path from the processor output and back to the processor input. The feedback path thus estimated generally incorporates the output transducer, the acoustic path back to the microphone, the microphone, and any preamplifiers. The feedback path is characterized by a transfer function. The feedback signal predictor—often referred to as a feedback signal estimator—comprises a filter that is adaptively controlled according to the correlation between said main signal processor output signal and the combination signal. The prevalence of high correlation is presumed to be due to acoustic feedback, and the feedback signal predictor in this way generates an estimate of the feedback path and produces a cancellation signal, which is then subtracted from the signal outputted by the microphone system. The feedback compensation feature allows the main signal processor to operate at a higher gain than otherwise possible.

WO-A-01/10169 shows a hearing aid with a controllable directional characteristic and with adaptive matching of input transducers. A controllable filter is inserted in at least one of two microphone channels for the purpose of equalizing the microphone output signals in gain and phase characteristics, which is important for the proper functioning of the directional systems.

WO-A-99/26453 shows a feedback compensation system for a hearing aid with two microphones and directional processing, wherein each microphone signal is independently feedback compensated before processing in a directional controller. Independently compensating each microphone signal before directional processing requires extensive processing and carries a risk that an imperfect compensation of the feedback signals will result in a residual feedback signal component, which may interfere with the function of the directional controller.

Generally, a feedback estimator estimates the transfer function in a part of the feedback loop extending from the signal processor output to the signal processor input. This part of the feedback loop mainly includes the output transducer, the acoustic path from output port to input port, the input transducer and circuitry associated with the input transducer.

The acoustic part of the feedback path may, according to a simple model, be regarded as a frequency dependent, attenuation and delay function. As the part of the feedback loop to be estimated actually includes on top of the acoustic path the output transducer, the input transducer and input circuitry, the complexity of this part of the feedback path may be considerable, especially in case of advanced hearing aids, and more sophisticated models may be appropriate to adequately mimic the feedback path.

Adaptive systems are examples of non-linear devices, or devices that can only be regarded as linear in short time segments. Non-linear devices present in an advanced input signal processor may include e.g. directional controllers, microphone matching circuits, preamplifiers and noise processors, and possible even adaptive versions of these systems.

SUMMARY OF THE INVENTION

It is an object of the invention to provide a processor for a hearing aid that combines directional processing capability with a feedback compensation capability. It is a further object of the present invention to provide a corresponding method, for processing of input transducer signals in a hearing aid, with improved feedback compensation.

Thus, it is an object of the invention to provide a processor, and a hearing aid incorporating such a processor, wherein at least one feedback compensation signal may be combined with signals derived from two, or more, microphone output signals, and wherein adaptive adjustment is applied to the directional controller.

It is a further object of the invention to provide a method whereby signals, derived from two or more microphone output signals, are combined with at least one feedback compensation signal and then adaptively combined to provide a feedback compensated directional controller output signal.

It is still another object of the invention to provide a processor for processing of input transducer signals in a hearing aid, wherein input signals are processed in a directional controller and wherein feedback compensation is performed without adversely affecting the function of the directional controller. It is also an object of the invention to provide a hearing aid wherein feedback compensation may be performed by a relatively simple feedback signal estimator—and where the total system complexity—evaluated e.g. as a processor load or gate count—is comparatively low.

This need is satisfied, according to the invention in a first aspect, by providing a hearing aid comprising: a first microphone for converting sound into a first audio signal; a second microphone for converting sound into a second audio signal; directional processing means for combining the first and the second audio signal to form a spatial signal; means for boosting low frequencies of the spatial signal in order to produce an equalized spatial signal; means for estimating a feedback path and for generating a feedback compensation signal; means for combining the feedback compensation signal with the equalized spatial signal in order to form a feedback compensated and equalized spatial signal, hearing aid processing means for processing the feedback compensated and equalized spatial signal to form a hearing loss compensation signal, an output transducer for converting the hearing loss compensation signal into an acoustic output, and an adaptive directional controller for controlling said directional processing means to provide adaptation of the spatial signal.

In this hearing aid, the feedback compensation is applied only after directional processing and low frequency boosting. Thus, the feedback path estimated includes the output transducer, the acoustic path, the microphones, the directional processing means, and the low-frequency booster but not the beamformer. This avoids interference by the feedback estimator with the function of the adaptive directional processing. Further it avoids amplifying by the low-frequency booster any residual errors in the feedback estimate.

The invention, in a second aspect, provides a hearing aid comprising: a first microphone for converting sound into a first audio signal; a second microphone for converting sound into a second audio signal; first directional processing means for combining the first and the second audio signal to form a first spatial signal; second directional processing means for combining the first and the second audio signal to form a second spatial signal; first equalizer means for boosting low frequencies of the first spatial signal in order to produce a first equalized spatial signal; second equalizer means for boosting low frequencies of the second spatial signal in order to produce a second equalized spatial signal; means for estimating a feedback path and for generating a feedback compensation signal, means for combining the feedback compensation signal with the first and the second equalized spatial signals in order to form a first and a second equalized and feedback compensated spatial signal; a beam former for combining the first and the second equalized and feedback compensated spatial signals in order to produce a beam former output signal; hearing aid processing means for processing the beam former output signal to form a hearing loss compensation signal; an output transducer for converting the hearing loss compensation signal into an acoustic output, and an adaptive directional controller for controlling the beam former in order to provide adaptation of the spatial signal.

Feedback compensation is applied after initial stages of directional processing and after low frequency boosting. The outputs of two directional processors are available for low frequency equalization and then for combination with feedback compensation signals, and the desired directional properties are obtained by controlling the combination of the feedback compensated signals. Thus, the feedback path estimated includes the output transducer, the acoustic path, the microphones, the directional processing means, and the low-frequency boosters, but not the beamformer.

Preferably, the means for estimating the feedback path are adapted to generate compensation signals in respect of each of the equalized, spatialized signals.

The invention, in a third aspect, provides a hearing aid comprising: a first microphone for converting sound into a first audio signal; a second microphone for converting sound into a second audio signal; first directional processing means for combining the first and the second audio signal to form a first spatial signal; second directional processing means for combining the first and the second audio signal to form a second spatial signal; a beam former for combining the first and the second spatial signals in order to produce a beam former output signal; equalizer means for boosting low frequencies of the beam former output signal in order to produce an equalized beam former output signal; means for estimating a feedback path and for generating a feedback compensation signal, means for combining the feedback compensation signal with the beam former output signal in order to form a feedback compensated and equalized spatial signal; hearing aid processing means for processing the feedback compensated and equalized spatial signal to form a hearing loss compensation signal; an output transducer for converting the hearing loss compensation signal into an acoustic output, and an adaptive directional controller for controlling said beam former in order to provide adaptation of the spatial signal.

In this hearing aid, feedback compensation is applied to a combined signal resulting from directional processing and equalizing. Thus, the feedback path estimated includes the output transducer, the acoustic path, the microphones, the directional processing means, the beamformer and the low-frequency booster. Here, a single feedback compensation signal is sufficient.

The invention, in a fourth aspect, provides a method of processing signals from a first and a second microphone in a hearing aid, comprising converting input signals from the first and the second microphones into a first and a second audio signal; combining the first and the second audio signal to form a spatial signal; boosting low frequencies of the spatial signal in order to produce an equalized spatial signal; estimating a feedback path and generating a feedback compensation signal, combining the feedback compensation signal with the equalized spatial signal in order to form a feedback compensated and equalized spatial signal; processing the feedback compensated and equalized spatial signal to form a hearing loss compensation signal; converting the hearing loss compensation signal into an acoustic output, and adaptively controlling the directional combining means to provide adaptation of the spatial signal.

According to this method, signals are subjected to, first, initial directional processing, secondly, to low frequency equalization, and, thirdly, to feedback compensation.

The invention, in a fifth aspect, provides a method of processing signals from a first and a second microphone in hearing aid, comprising converting an input signal from a first microphone into a first audio signal; converting an input signal from a second microphone into a second audio signal; combining the first and the second audio signal to form a first spatial signal; combining the first and the second audio signal to form a second spatial signal; boosting low frequencies of the first spatial signal in order to produce a first equalized spatial signal; boosting low frequencies of the second spatial signal in order to produce a second equalized spatial signal; estimating a feedback path and for generating a feedback compensation signal, combining the feedback compensation signal with the first and the second equalized spatial signals in order to form a first and a second equalized and feedback compensated spatial signal; combining the first and the second equalized and feedback compensated spatial signals in a beam former in order to produce a beam former output signal; processing the beam former output signal to form a hearing loss compensation signal; converting the hearing loss compensation signal into an acoustic output, and controlling the beam former in order to provide adaptation of the spatial signal.

According to this method, signals are subjected to, first, initial directional processing, secondly, to low frequency equalization, and, thirdly, to feedback compensation.

Embodiments of the invention appear from the dependent claims.

BRIEF DESCRIPTION OF THE DRAWINGS

Further embodiments and details of the invention will appear from the detailed description. The description will refer to the appended figures, where.

DETAILED DESCRIPTION OF THE INVENTION

Figure 1:
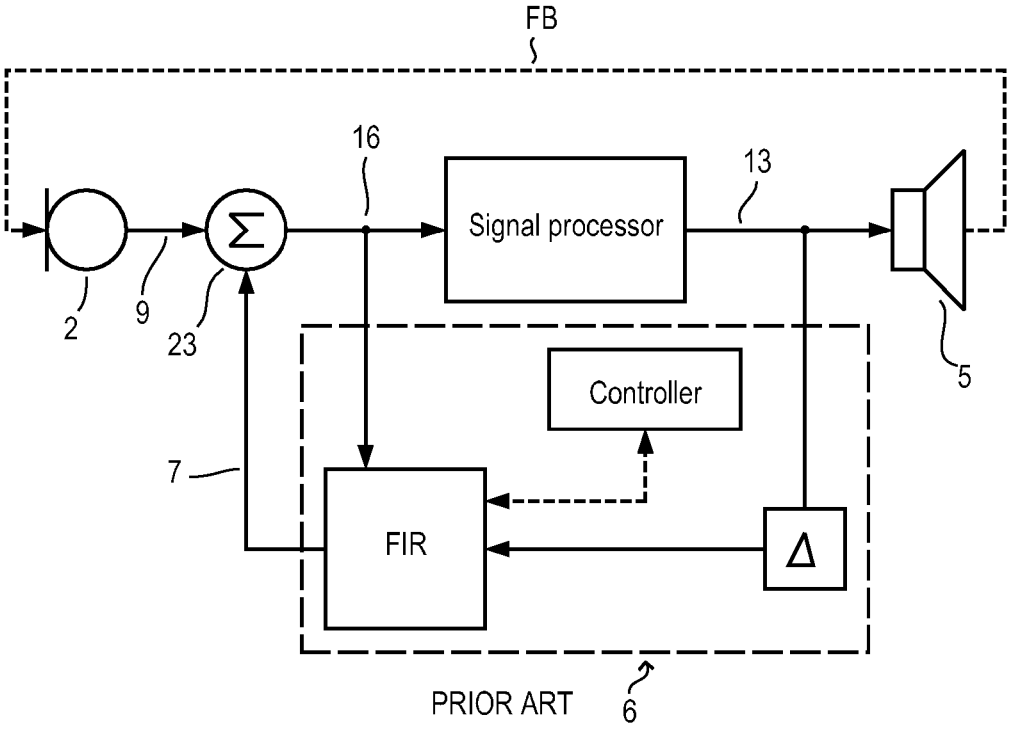
PRIOR ART Fig. 1
FIG. 1 illustrates a feedback compensation system according to the prior art.

Reference is first made to FIG. 1, which shows an example of a feedback compensating system, known from EP-A-1191814. In this system the feedback path through receiver 5, acoustic feedback path (FB) and microphone 2 is modelled by the feedback signal estimator 6, which outputs a feedback compensating signal 7 based on an estimator input signal. This is obtained by adaptively controlling the controllable filter in the feedback signal estimator 6 such that the correlation between the estimator input signal and the feedback compensated signal 16 is minimized—typically by implementing a minimizing LMS method in the adaptive controller. The generated feedback compensating signal 7 is then combined in adder 23 with the microphone signal 9 to generate the feedback compensated signal 16 which is used as the main signal processor input signal 11. The main signal processor input signal is processed in the main signal processor to form the main processor output signal 13 for the receiver 5. The processor is adapted to achieve the required hearing loss compensation signal, possibly modified according to other processing adapted to achieve noise reduction or speech enhancement, as will be evident to those skilled in the relevant art. EP-A-1191814 briefly mentions that the hearing aid may include a plurality of input transducers whereby direction sensitive characteristics might be provided.

Figure 2:
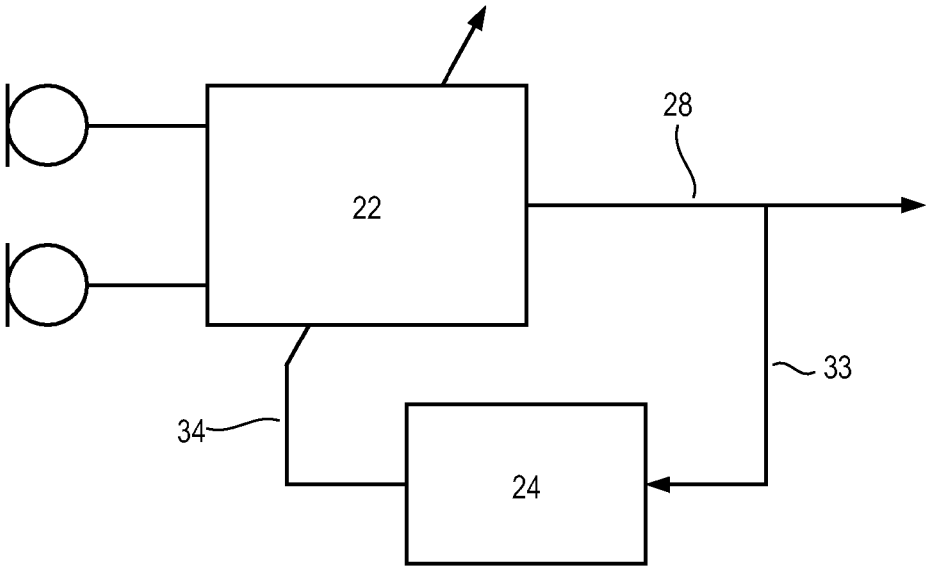
PRIOR ART Fig. 2
FIG. 2 illustrates an adaptive directional controller according to the prior art.

Reference is now made to FIG. 2, which shows an example of adaptive control of the directional controller corresponding to the description in WO-A-02/085066. In this example, a directional controller 22 adapted for having the directional characteristic controlled by a single parameter input, is controlled by the adaptive control signal 34 according to a criterion that the power of the spatially modified output signal 28, which is used as an adaptive controller input signal 33, is minimized. This is obtained by implementing an iterative minimizing method in the adaptive controller 24, e.g. by minimizing the signal power. Other embodiments may feature minimization according to other criteria, also referred to as cost-functions, as will be familiar to, and sometimes preferred by, the skilled person.

Figure 3:
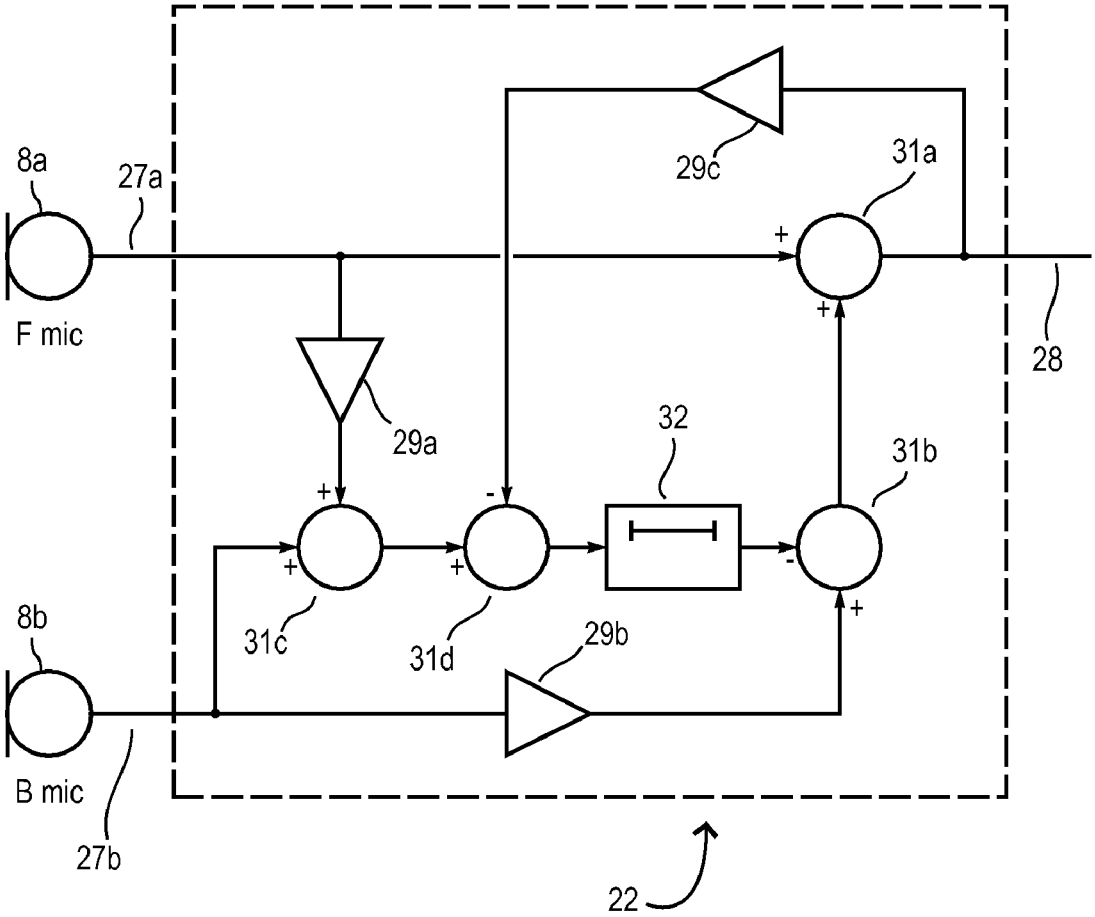
PRIOR ART Fig. 3
FIG. 3 illustrates a directional controller according to the prior art.

Reference is now made to FIG. 3, which shows an example of a directional controller as suggested in WO-A-01/01731. For simplicity, this figure omits some optional input processing components, and just shows the microphone output signals as identical to the directional controller input signals 27*a*, 27*b*.

Basically, a directional characteristic may be obtained by processing the outputs from two omni-directional microphones so as to delay the signal from the rear microphone in the array (the back-microphone) by an amount corresponding to the acoustic delay between the microphones and to subtract this delayed signal from the front microphone signal. In this way a characteristic known as a cardioid characteristic is obtained.

The controller shown in FIG. 3 implements this feature by using amplifiers 29*a*, 29*b*, 29*c*, a delay 32 and subtractors 31*b*, 31*d* to process the microphone signals and combine them to a spatially modified output signal 28. The shape of the directivity pattern or the directional characteristic may be controlled by adjusting the gain settings in the amplifiers 29*a*, 29*b*. One particular advantage to this design is that a low-frequency boost may be implemented inside the directional controller itself, with very simple components, by a feedback connection through a dedicated amplifier 29*c*. Further details and advantages of this design are explained in WO-A-01/01731.

Figure 4:
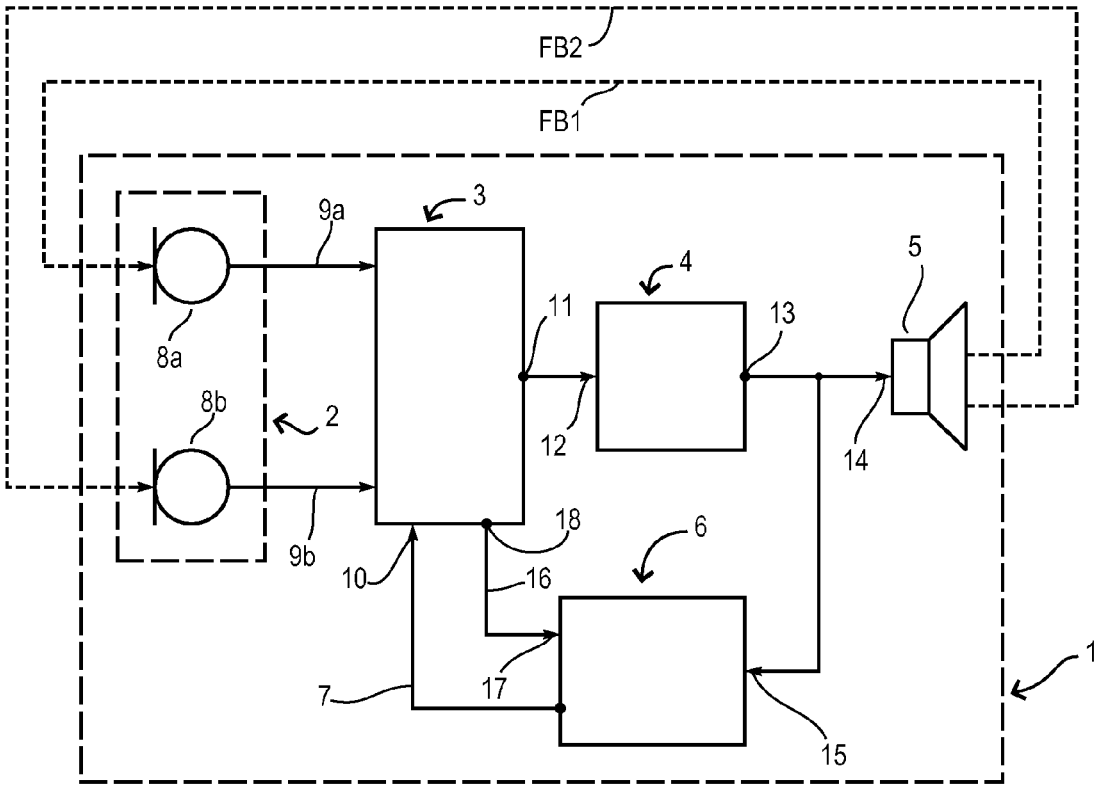
FIG. 4 illustrates a hearing aid with a directional controller and an FBC system.

Reference is now made to FIG. 4, which shows a hearing aid 1 according to an embodiment of the invention. It comprises a microphone array 2, an input processor 3, a main signal processor 4, an output transducer 5, and a feedback signal estimator 6 for generation of a feedback compensation signal 7. The feedback compensation signal 7, which is an estimated feedback signal, is transferred from the output 38 of the feedback signal estimator 6 to the compensation input 10 on the input processor 3. The microphone array 2 comprises two input transducers 8*a*, 8*b*, each transducer being connected to the input processor through a respective connection 9*a*, 9*b*. The first output 11 of the input processor 3 is connected to the input 12 of the main signal processor 4, while the main signal processor 4 output signal 14 is fed to the input of the output transducer 5 and to the input 15 of the feedback signal estimator 6. The feedback signal estimator 6 receives a feedback compensated signal 16 from the second output 18 of the input processor 3 at the control input 17 of the feedback signal estimator. FIG. 4 also shows the acoustic feedback paths FB1, FB2 that exist between the output transducer 5 and each of the microphones 8*a*, 8*b*. The output transducer is preferably an ordinary type hearing aid receiver. Suitable receivers are commercially available from Knowles Electronics of Itasca Ill. of the USA and others.

The input processor 3 comprises means for processing the microphone input signals and the feedback-compensating signal in order to generate a feedback compensated signal 16. Specifically the input processor comprises a directional controller system and means for low frequency boosting of the output signal of the directional controller system. The feedback compensated input processor output signal 11 is transferred to the main signal processor 4. The main signal processor takes this as input and performs suitable processing in order to achieve the required hearing loss compensation and, possibly, other processing such as noise reduction or speech enhancement. It will be understood by the skilled person, that the invention imposes no special requirements on the main signal processor. Rather, any design of the main signal processor known to a skilled person can be used.

In the preferred embodiment, the input transducers 8*a*, 8*b*, are omni-directional microphones. In other embodiments some, or all, of the microphones may alternatively be directional microphones, which are thus included in the microphone array. It is also well known to the skilled person that microphone arrays for hearing aids may comprise more than two microphones. However, considering the costs of using more than two microphones in terms of the added complexity of the circuitry needed to include such additional microphones in the array, the embodiment with only two microphones 8*a*, 8*b* is presently preferred.

The hearing aid 1 may be of the multi-band type, i.e. it is adapted for dividing the full audible frequency spectrum into several bands for individual processing. In such a hearing aid, several, possibly all, bands may comprise an input processor 3 according to the invention, whereby an improved functionality of the directional system may be obtained. Alternatively, an input processor 3, according to the invention, may be utilized as a single band front end to the multi-band system.

Figure 5:
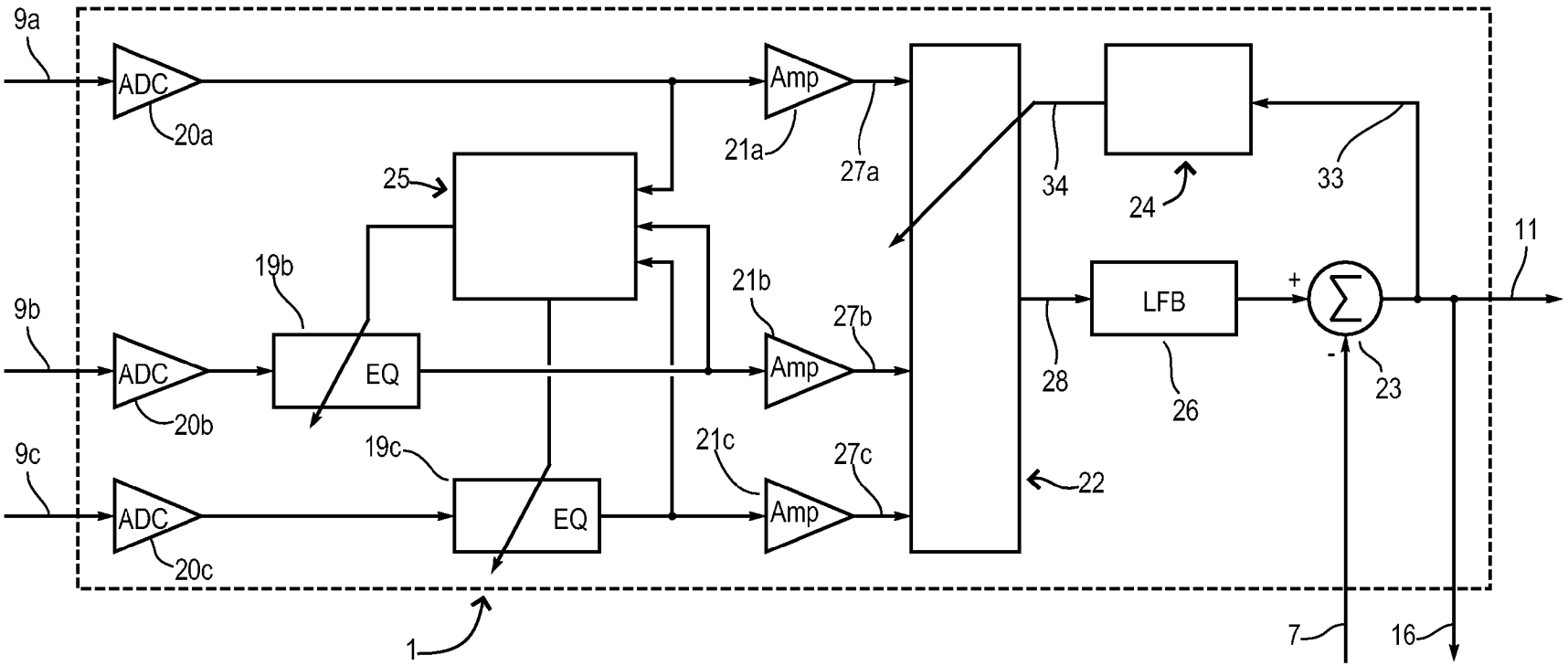
FIG. 5 illustrates the input system of the hearing aid shown in FIG. 4.

FIG. 5 shows one example of an input processor 3 adapted for a hearing aid with three microphones. The input processor in FIG. 5 comprises inputs 9*a*, 9*b* and 9*c*, microphone matching amplifiers 19*b*, 19*c* with an associated matching controller 25, three A/D converters 20*a*, 20*b*, 20*c*, three preamplifiers 21*a*, 21*b*, 21*c*, a directional controller 22, a subtractor 23 and an adaptive controller 24 for control of the directional controller 22.

The microphone matching system 19*b*, 19*c*, 25 serves to equalize the gain and phase characteristics of the microphones, in order to achieve optimum performance in the directional system. For this purpose, controlled matching amplifiers 19*b*, 19*c* may be connected to all but one of the microphone connections. The matching controller 25 controls the adjustment of the matching amplifiers. Several ways of implementing such an adaptive matching system will be known to the skilled person, one example being disclosed in WO-A-01/10169. An alternative to the use of an adaptive matching system would be either the use of a manually adjustable system or the use of matched pairs of microphones. However, in order to achieve long-term stability, it is preferred to use an adaptive matching system.

To modify the design of FIG. 5 for use with two microphones, the components 20*c*, 19*c*, and 21*c* connected to the third microphone output 9*c* would be removed and an appropriately configured directional controller 22, i.e. a two microphone configuration, would be selected.

In the example shown in FIG. 5, analogue to digital (A/D) converters 20*a*, 20*b*, 20*c* are arranged to process the microphone outputs 9*a*, 9*b*, 9*c*. In variations of the design of FIG. 5 aimed at maximizing the signal-noise ratio the preamplifiers 21*a*, 21*b*, 21*c* could precede the equalizers or, alternatively, A/D converters with amplification could precede the equalizers. In still other embodiments, the preamplifiers could be dispensed with.

The directional controller 22 may be a generalized version of the directional controller shown in WO-A-01/01731 (mentioned above). The directional controller 22 takes input signals 27*a*, 27*b*, 27*c* derived from the input transducer signals 9*a*, 9*b*, 9*c* and generates a single, spatially modified, output signal 28. Thus, by processing the derived input transducer signals 9 in the directional controller 22, the spatially modified output signal 28 has the characteristic of the output signal of a directional microphone that exhibits the desired directional pattern. The directional controller may be similar to the controller shown in FIG. 3. The adaptive controller 24 may be implemented in the input processor 3 by processing either the feedback compensated signal 11, or—preferably—the output signal of the low-frequency booster 26, or the output signal of the directional controller 22. The adaptive control of the directional controller 22 may be similar to the one described in WO-A-02/085066.

Finally, the input processor 3 comprises a combining device 23, for combining the feedback compensating signal 7 with the output from the low-frequency booster 26, thereby generating the input processor output signal 11, which—in this configuration—is identical to the feedback compensated signal 16. The feedback compensation technique per se may be as described in detail in EP-A-1191814. It will be obvious to the skilled person that even though the directional controllers 24, 25 utilized in the input processor 3 have been described as independent controllers they may be embedded—possibly, with other processor components of the hearing aid—in some kind of digital signal processor (DSP) or other kinds of integrated circuits, e.g. ASICs. Thus, in the complete design, the controllers 24, 25 may be totally integrated in the processor.

As there are multiple input transducer signals, multiple feedback signal estimators adapted to provide multiple feedback compensating signals for respective input channels might provide a more accurate compensation. This would be a very expensive solution, in terms of hardware and processing resources. However, assuming that the multiple feedback paths are almost identical, it may be sufficient to apply identical feedback compensating signals to all input transducer output signals, or, as shown in FIG. 5, to apply a single feedback compensation signal onto a combination signal. Thus, although the embodiment shown in FIG. 5 features three input channels, suitable for processing inputs from e.g. three microphones, only a single feedback compensation signal is applied.

Any directional controller that uses the subtraction principle to generate a directional characteristic inherently causes a low-frequency roll-off of the output signal. Applying a low-frequency boost, i.e. a frequency dependent amplification for enhancing the low frequencies, may alleviate this problem. The embodiment shown in FIG. 5 implements this feature through the inclusion of a dedicated low-frequency booster amplifier 26. However, in the design shown in FIG. 3, low frequency boosting is implemented by introducing a feedback component by using an amplifier 29*c* and a subtractor 31*d*. In this way low frequency boosting is incorporated as part of the directional controller 22.

The feature of applying low frequency boost may in itself cause a problem as it lifts also low-frequency noise. Directional processing inherently suppresses low frequencies and therefore progressively reduces signal-to-noise ratio. Boosting may lift the signal, but it is preferred to cap the lift, i.e. to operate less than 100% compensation, so as to avoid lifting the noise too much.

Furthermore, any residual error left by, or generated by, the feedback canceller will be amplified as well. In order to avoid amplification of this residual error by the low-frequency booster means, it is generally preferred to apply feedback compensation only after low-frequency equalizing, such as shown in the layout of FIG. 5.

It is to be understood, that in the context of this disclosure, the concept of a directional controller is to be taken in a general sense, i.e. to comprise any kind of device whereby directional properties are imposed on a combination of multiple acoustic input signals. Examples may comprise a device whose directional properties may be pre-adjusted but which is not adjusted during ordinary use, a device with directional but not currently adjustable properties, or an ordinary directional microphone. It will be evident to the skilled person, that if an omni-directional microphone is used as one of the directional controllers, no low frequency equalization will be needed for that directional controller.

Figure 6:
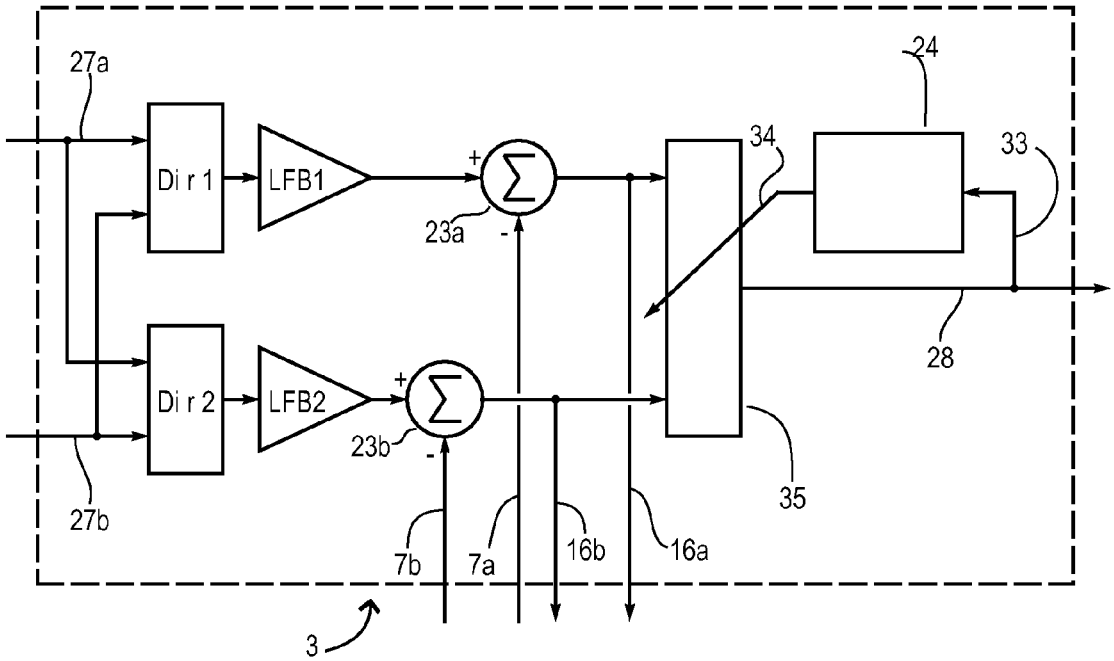
FIG. 6 illustrates a directional controller according to the invention.

FIG. 6 shows an input processor 3 according to a second embodiment of the invention. For simplicity, components 19*a*, 19*b*, 19*c*, 20*a*, 20*b*, 20*c*, 21*a*, 21*b*, 21*c*, 25 as explained in relation to FIG. 5 have been omitted from FIG. 6. FIG. 6 shows a processor for two input channels with two directional controllers Dir1, Dir2. Each of these directional controllers receives input signals 27*a*, 27*b* from both the input channels. Processing of the inputs prior to the directional controllers includes deriving signals from two microphone outputs, digitizing and then matching by a microphone matching system. Each of the directional controllers generates a fixed directional characteristic. After processing in these directional controllers the signals may be subjected to low frequency boost in the amplifiers (LFB). Further details will be described below with reference to FIG. 10.

The signals thus generated are then combined in respective adders 23*a*, 23*b* with corresponding feedback compensating signals 7*a*, 7*b*. These signals may be generated by feedback signal estimators similar to the feedback signal estimator 6 described in connection with the description of FIG. 1.

The feedback compensated signals 16*a*, 16*b* are made available for use as control input(s) to the feedback signal estimator(s) and for processing in a signal combiner 35. Adaptive controller 24 adaptively controls this combiner 35, such that a cost-function, e.g. the signal power of the output signal 33, is minimized. The preferred design of the signal combiner 35 is shown in detail in FIG. 7.

The directional controllers Dir1, Dir2 are designed to achieve that a combination in combiner 35 of their respective output signals will generate a directional characteristic according to the ratio in which they are combined. The adaptive control 24 dynamically adapts the combination ratio of the signal combiner 35 so as to produce a combination output signal that minimizes the environmental noise received by the hearing aid microphone system. Preferably, a first one of the directional controllers Dir1, Dir2 is adapted to produce an omni-directional characteristic while a second one produces a cardioid characteristic—specifically, a cardioid characteristic known as a back-cardioid, i.e. cardioid characteristic with a null pointing in a direction opposite of the intended sound source (suitable if the conversational partner is situated in the forward direction).

Alternatively, the characteristics may be those of a front-cardioid and a back-cardioid. Actually, multiple characteristics will be available for the choice by the skilled person—it is even possible that one of the directional controller output signals could be substituted by a signal from a directional microphone.

This arrangement avoids incorporating the complex and time-varying component of an adaptively controlled, equalized directional controller into the part of the feedback path that needs to be estimated by the feedback signal estimator, and thereby eases the function requirements to the feedback estimator. In the embodiment of FIG. 6, fixed directional controllers are arranged first in the processing chain, then low-frequency boosters, and then adders for feedback compensation, while the desired adaptive directional property is achieved in a subsequent stage by a weighted mixing of the outputs of several of such systems. Hereby the adaptive part of the directional controller is placed outside of the part of the feedback path to be estimated by the feedback estimator.

In a variation of this embodiment, more than two directional controllers Dir1, Dir2 may be utilized. For this, the signal combiner 35 will be modified to combine a corresponding number of input signals. Accordingly, the problem to be solved by the adaptive controller 24 will be that of optimizing the vector that controls the signal combiner 35 such that the cost-function is minimized, contrary to the situation with two directional controllers, where a scalar is minimized. Methods for this are readily available in the prior art, and are considered well known to the skilled person. However, since the use of more than two directional controllers requires generation of more than two feedback-compensating signals, it is presently preferred to apply just two directional controllers.

Figure 7:
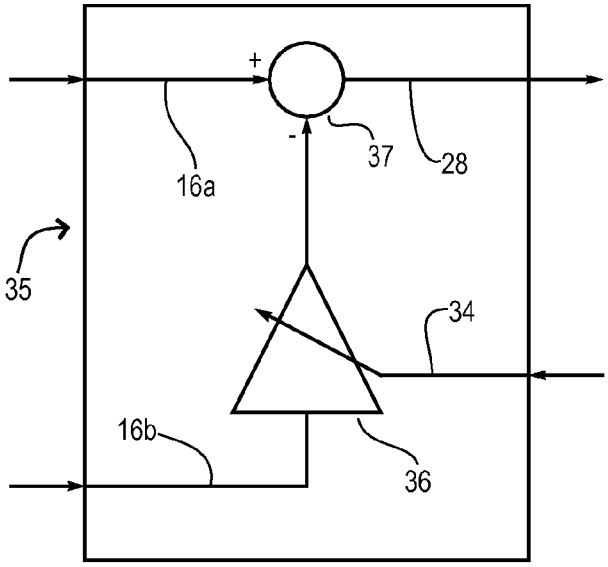
FIG. 7 illustrates a signal combiner, for use according to the invention.

In FIG. 7 a signal combiner 35, according to a particular embodiment of the invention, is shown. According to this embodiment, one feedback compensated signal 16*b* is amplified in a controllable amplifier 36 and then combined in subtractor 37 with the other feedback compensated signal 16*a*. The skilled person will be able to suggest other ways of designing such a controlled signal combiner.

Figure 8:
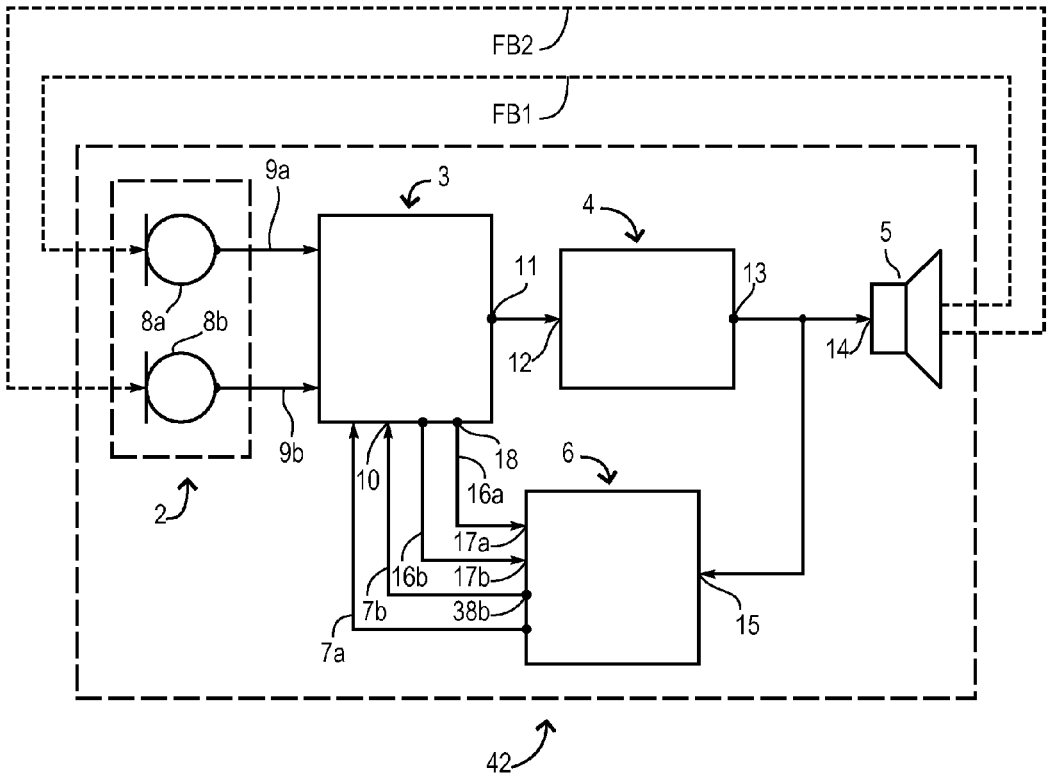
FIG. 8 illustrates one embodiment of a hearing aid according to the invention.

In FIG. 8, a hearing aid 42 according to an embodiment of the invention is shown. Notably, it is shown that the feedback signal estimator 6 generates feedback compensating signals 7*a*, 7*b*, each signal being adapted for compensation of a respective fixed directional controller. Also, it is shown that the feedback signal estimator 6 receives the feedback compensated signals 16*a*, 16*b* as well as the processor output signal 15 for processing. In other respects the hearing aid 42 according to this embodiment is similar to the hearing aid 1 shown in FIG. 4.

Figure 9:
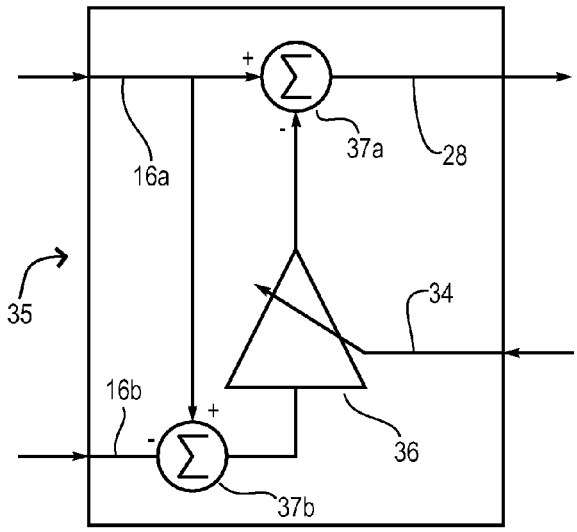
FIG. 9 illustrates another signal combiner for a hearing aid according to the invention.

In FIG. 9, a modified signal combiner 35 is shown. In this, preferred, mode of operation, the first directional signal 16*a* is assumed to exhibit an omni-directional characteristic, while the second directional signal 16*b* is assumed to exhibit a bi-directional characteristic, i.e. a figure-of-eight with a front lobe and a back lobe, wherein the back lobe signal is opposed in phase to the front lobe signal. The combination of these signals in a second subtractor 37*b* produces an input signal to the controllable amplifier 36 that possesses the characteristics of a back-cardioid—i.e. a cardioid with the null pointing in the forward direction. By subtracting an adaptively attenuated signal—derived from the output signal of the second subtractor 37*b* in the controlled amplifier 36—from the omni-directional signal 16*a* in the first subtractor 37*a*, an adaptively controlled attenuation of signals positioned outside the desired range of directions will be obtained. Thus, the combiner is capable of effectively outputting a signal according to directional sensitivity patterns ranging from omni-directional, through a front cardioid and to a figure-of-eight with controlled null-directions. Further description is given in WO-A-02/085066.

It will be obvious to the skilled person, that the bi-directional characteristic used in this embodiment, is to be generated by subtracting the back-microphone signal from the front-microphone signal.

Figure 10:
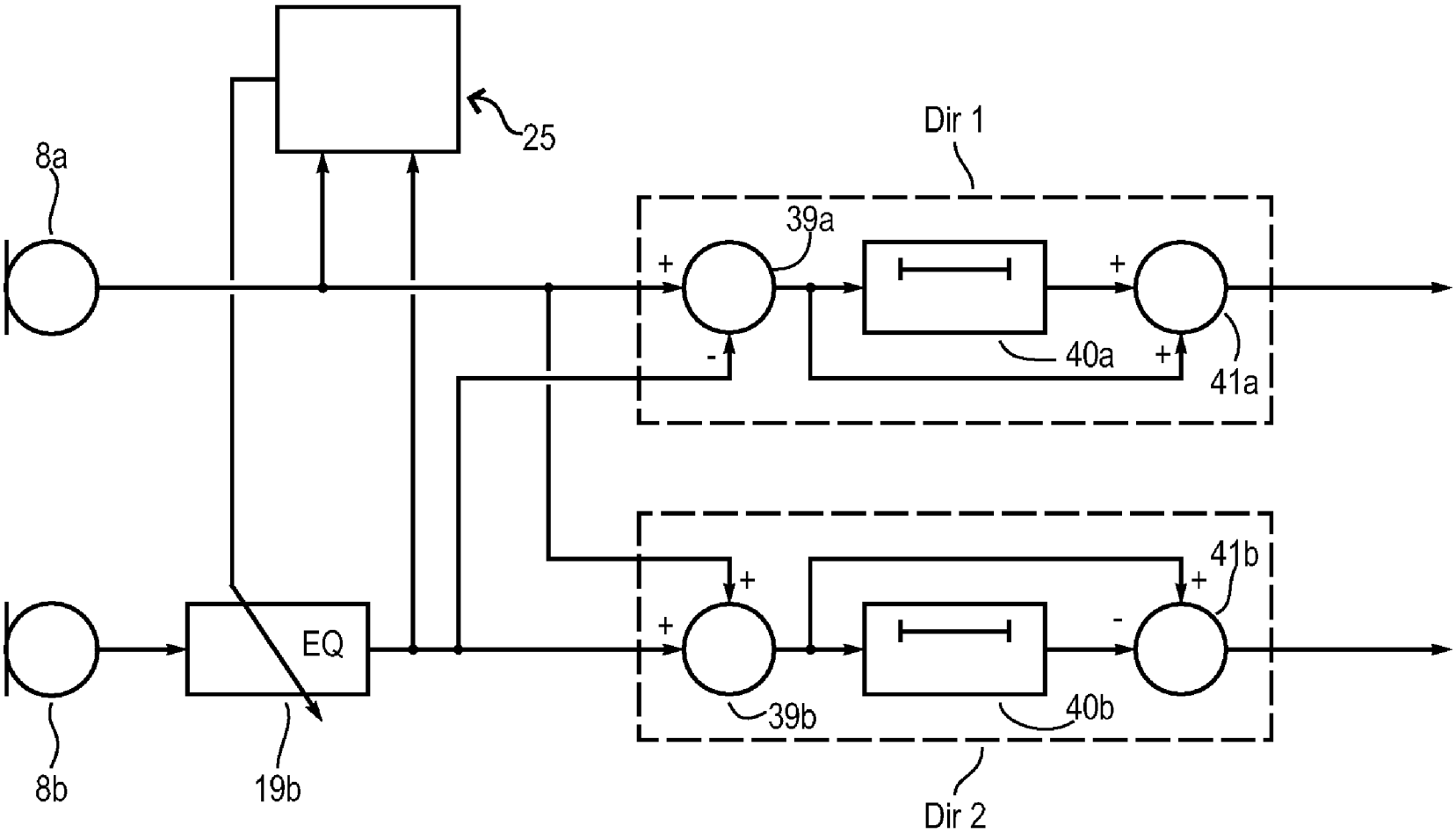
FIG. 10 illustrates a part of the input processor according to an embodiment of the invention.

Reference is now made to FIG. 10, which shows details of the input processor 3 of the embodiment shown in FIG. 6. FIG. 10 shows the microphones 8*a*, 8*b*, matching amplifier 19*b*, matching controller 25, and directional controllers Dir1, Dir2. The directional controllers each includes a set of first adding circuit 39*a*, 39*b*, phase delay device 40*a*, 40*b*, and second adding means 41*a*, 41*b*. Thus, each of the directional controllers outputs a signal according to a respective fixed sensitivity pattern, and adaptation of directivity is obtained further downstream by appropriate processing of the signals output by the directional controllers (re. FIG. 6).

We claim:

1. A hearing aid comprising:

a first microphone for converting sound into a first audio signal;

a second microphone for converting sound into a second audio signal;

directional processing means for combining the first and the second audio signal to form a spatial signal;

means for boosting low frequencies of the spatial signal in order to produce an equalized spatial signal;

means for estimating a feedback path and for generating a feedback compensation signal;

means for combining the feedback compensation signal with the equalized spatial signal in order to form a feedback compensated and equalized spatial signal, hearing aid processing means for processing the feedback compensated and equalized spatial signal to form a hearing loss compensation signal, an output transducer for converting the hearing loss compensation signal into an acoustic output, and an adaptive directional controller for controlling said directional processing means to provide adaptation of the spatial signal.

2. The hearing aid according to claim 1, comprising means for adaptive matching of the first and the second audio signals with respect to gain and phase characteristics of said first and said second microphones.

3. The hearing aid according to claim 1, wherein said means for boosting low frequencies is combined with said directional processing means.

4. A hearing aid comprising:

a first microphone for converting sound into a first audio signal;

a second microphone for converting sound into a second audio signal;

first directional processing means for combining the first and the second audio signal to form a first spatial signal;

second directional processing means for combining the first and the second audio signal to form a second spatial signal;

first equalizer means for boosting low frequencies of the first spatial signal in order to produce a first equalized spatial signal;

second equalizer means for boosting low frequencies of the second spatial signal in order to produce a second equalized spatial signal;

means for estimating a feedback path and for generating a feedback compensation signal, means for combining the feedback compensation signal with the first and the second equalized spatial signals in order to form a first and a second equalized and feedback compensated spatial signal;

a beam former for combining the first and the second equalized and feedback compensated spatial signals in order to produce a beam former output signal;

hearing aid processing means for processing the beam former output signal to form a hearing loss compensation signal;

an output transducer for converting the hearing loss compensation signal into an acoustic output, and an adaptive directional controller for controlling the beam former in order to provide adaptation of the spatial signal.

5. The hearing aid according to claim 4, wherein said first directional processing means is adapted to produce a first fixed spatial output signal according to a first, fixed sensitivity pattern, and said second directional processing means is adapted to produce a second fixed spatial output signal according to a second, fixed sensitivity pattern.

6. The hearing aid according to claim 4, comprising means for adaptive matching of the first and the second audio signals for matching the first and the second audio signals with respect to gain and phase characteristics of said first and said second microphones.

7. A hearing aid comprising:

a first microphone for converting sound into a first audio signal;

a second microphone for converting sound into a second audio signal;

first directional processing means for combining the first and the second audio signal to form a first spatial signal;

second directional processing means for combining the first and the second audio signal to form a second spatial signal;

a beam former for combining the first and the second spatial signals in order to produce a beam former output signal;

equalizer means for boosting low frequencies of the beam former output signal in order to produce an equalized beam former output signal;

means for estimating a feedback path and for generating a feedback compensation signal, means for combining the feedback compensation signal with the beam former output signal in order to form a feedback compensated and equalized spatial signal;

hearing aid processing means for processing the feedback compensated and equalized spatial signal to form a hearing loss compensation signal;

an output transducer for converting the hearing loss compensation signal into an acoustic output, and an adaptive directional controller for controlling said beam former in order to provide adaptation of the spatial signal.

8. The hearing aid according to claim 7, comprising means for adaptive matching of the first and the second audio signals for matching the first and the second audio signals with respect to gain and phase characteristics of said first and said second microphones.

9. A method of processing signals from a first and a second microphone in a hearing aid, comprising converting input signals from the first and the second microphones into a first and a second audio signal;

combining the first and the second audio signal to form a spatial signal;

boosting low frequencies of the spatial signal in order to produce an equalized spatial signal;

estimating a feedback path and generating a feedback compensation signal, combining the feedback compensation signal with the equalized spatial signal in order to form a feedback compensated and equalized spatial signal;

processing the feedback compensated and equalized spatial signal to form a hearing loss compensation signal;

converting the hearing loss compensation signal into an acoustic output, and adaptively controlling the directional combining means to provide adaptation of the spatial signal.

10. The method according to claim 9, comprising adaptively matching of the first and the second audio signals for matching said first and said second audio signals with respect to gain and phase characteristics of said first and said second microphones.

11. A method of processing signals from a first and a second microphone in a hearing aid, comprising:

converting an input signal from a first microphone into a first audio signal;

converting an input signal from a second microphone into a second audio signal;

combining the first and the second audio signal to form a first spatial signal;

combining the first and the second audio signal to form a second spatial signal;

boosting low frequencies of the first spatial signal in order to produce a first equalized spatial signal;

boosting low frequencies of the second spatial signal in order to produce a second equalized spatial signal;

estimating a feedback path and generating a feedback compensation signal, combining the feedback compensation signal with the first and the second equalized spatial signals in order to form a first and a second equalized and feedback compensated spatial signal;

combining the first and the second equalized and feedback compensated spatial signals in a beam former in order to produce a beam former output signal;

processing the beam former output signal to form a hearing loss compensation signal;

converting the hearing loss compensation signal into an acoustic output, and controlling the beam former in order to provide adaptation of the spatial signal.

12. The method according to claim 11, comprising estimating a feedback path and generating a feedback compensation signal in respect of each of the first and the second equalized spatial signals.

13. The method according to claim 11, comprising producing in a first directional processing means a first fixed spatial output signal according to a first, fixed sensitivity pattern, and producing in a second directional processing means a second fixed spatial output signal according to a second, fixed sensitivity pattern.

* * * * *